US005230553A

United States Patent [19]

Tuller

[11] Patent Number: 5,230,553

[45] Date of Patent: Jul. 27, 1993

[54] METHOD AND MEANS FOR DISHWASHER TUB AND SUPPORT ASSEMBLY

[75] Inventor: Barry E. Tuller, Newton, Iowa

[73] Assignee: Maytag Corporation, Newton, Iowa

[21] Appl. No.: 804,799

[22] Filed: Dec. 9, 1991

[51] Int. Cl.[5] ..... A47B 77/00

[52] U.S. Cl. ..... 312/228; 312/229; 312/265.6

[58] Field of Search ..... 312/228, 229, 276, 190.4, 312/265.6, 290, 107, 111; 4/619; 126/191, 194

[56] References Cited

U.S. PATENT DOCUMENTS

| | | | |
|---|---|---|---|
| 2,146,939 | 2/1939 | Coordes | 312/228 |
| 2,192,862 | 3/1940 | Eagley | 312/290 |
| 3,063,766 | 11/1962 | Goettl | 312/228 |
| 3,159,436 | 12/1964 | Davis | 312/107 |
| 4,015,886 | 4/1977 | Wickenberg | 312/107 |
| 4,103,981 | 8/1978 | Donahue et al. | 312/265.6 |

*Primary Examiner*—Victor N. Sakran
*Attorney, Agent, or Firm*—Zarley, McKee, Thomte, Voorhees & Sease

[57] ABSTRACT

A dishwasher tub and support assembly includes a base having a horizontal base support member with first and second spaced apart apertures being formed therein. A tub includes a pair of pedestal legs having a first and second pair of tabs extending downwardly therefrom. The tabs are positioned so as to register with the spaced apart first and second apertures of the base. The first pair of tabs is inserted into the first apertures of the base, and the tub is pivoted so that the second pair of tabs fit within the second apertures of the base. Both the first and second tabs hold the tub against vertical and horizontal movement relative to the base.

15 Claims, 3 Drawing Sheets

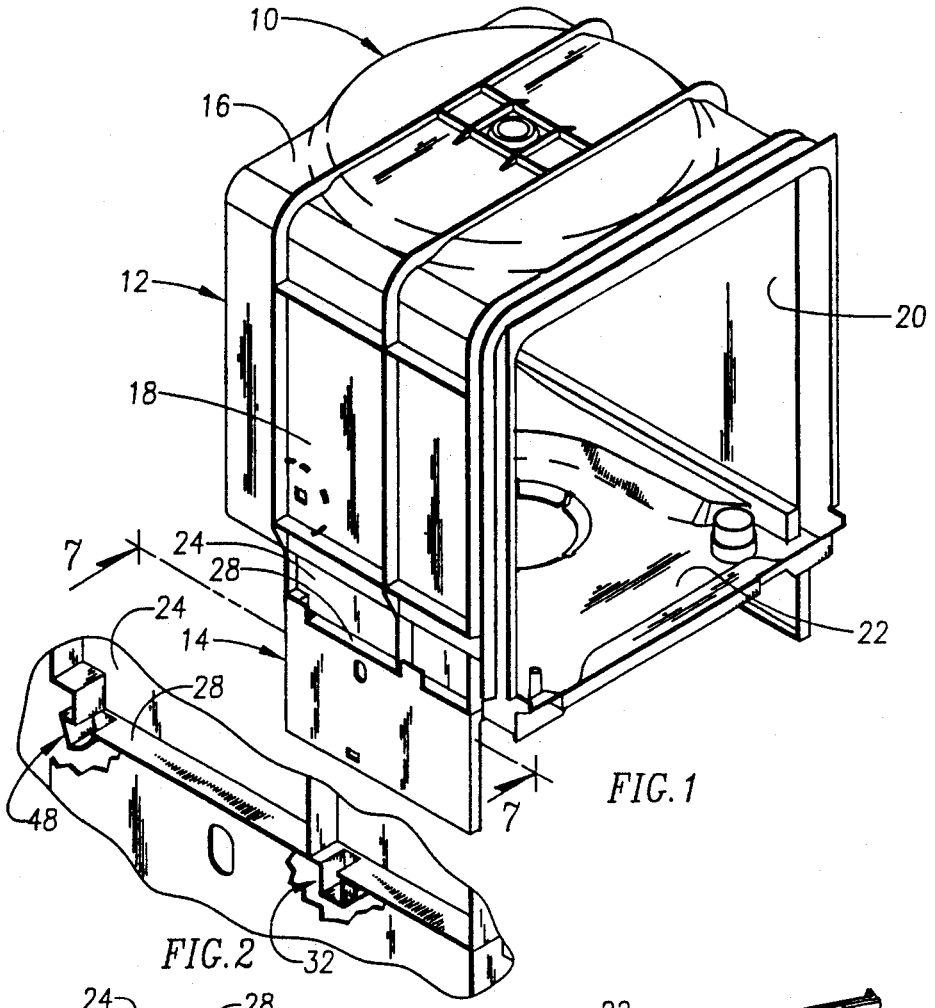
FIG. 1
FIG. 2
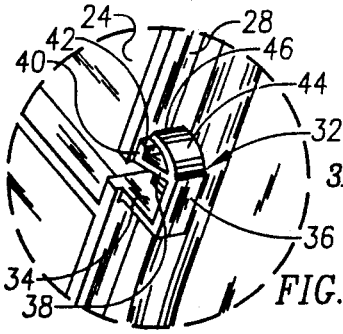
FIG. 3A
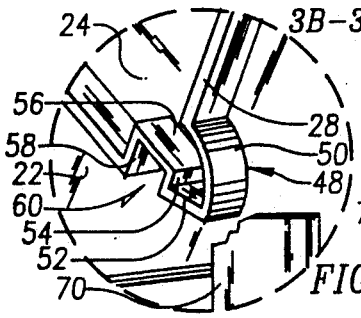
FIG. 3B
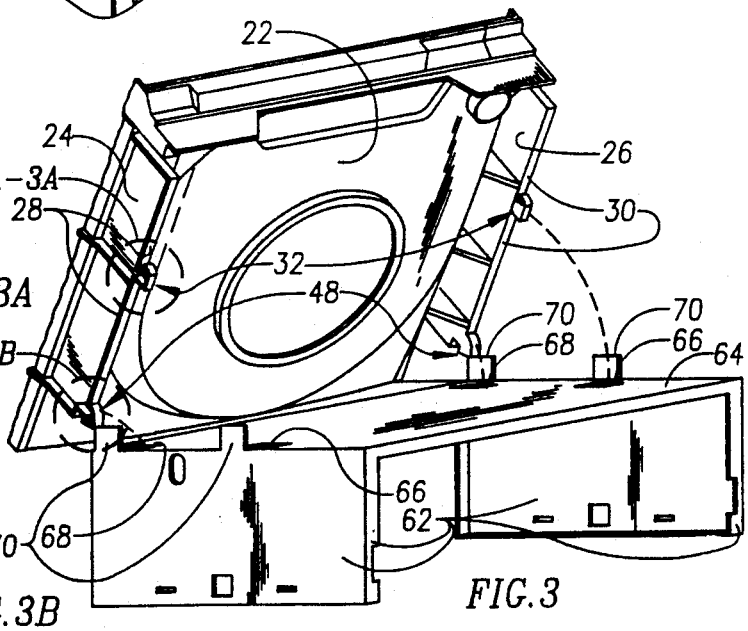
FIG. 3

METHOD AND MEANS FOR DISHWASHER TUB AND SUPPORT ASSEMBLY

BACKGROUND OF THE INVENTION

This invention relates to a method and means for dishwasher tub and support assembly.

A typical dishwasher comprises a tub having a washing compartment therein, and a base support on which the tub is mounted and supported. Various means have been provided for mounting the tub to the base support.

In order to improve the efficiency and quickness with which the tub may be mounted to the base support, it is desirable to minimize the number of fasteners such as screws or rivets utilized in the assembly process. It is also desirable to minimize the number of steps or movements which are necessary in order to assemble the two pieces together.

SUMMARY OF THE INVENTION

Therefore a primary object of the present invention is the provision of an improved method and means for dishwasher tub and support assembly.

A further object of the present invention is the provision of an improved method and means for dishwasher tub and support assembly which requires no screws, rivets, or other fasteners.

A further object of the present invention is the provision of an improved method and means for dishwasher tub and support assembly which permits the tub to be assembled to the support with a single pivoting action.

A further object of the present invention is the provision of an improved method and means for dishwasher tub and support assembly which provides tabs on extensions of the tub sidewalls which are adapted to matingly fit within apertures formed in the base support.

A further object of the present invention is the provision of an improved method and means for dishwasher tub and support assembly which holds the tub against both horizontal and vertical movement with respect to the base support after the two have been assembled.

A further object of the present invention is the provision of an improved method and means for dishwasher tub and support assembly which permits the assembly of the tub to the support by a single pivoting motion and which does not require relative horizontal movement of the tub with respect to the base support during assembly.

A further object of the present invention is the provision of a method and means for dishwasher tub and support assembly which is economical, efficient in use, and which results in a durable assembly.

The present invention utilizes a dishwasher tub having a top tub wall, a bottom tub wall, a back tub wall, and opposite side tub walls forming a washing compartment therein. The front of the washing compartment is open and is adapted to accommodate a hinged door for access to the washing compartment.

Extending downwardly from the opposite sidewalls of the tub are a pair of pedestal walls. Mounted on the lower edges of the pedestal walls are a first pair and a second pair of tabs.

The base comprises a horizontal base support member having a pair of opposite side legs which extend downwardly therefrom. The horizontal base support member includes a first pair of apertures therein and a second pair of apertures therein. The spacing of the first and second apertures is closely matched to the spacing between the first and second pairs of tabs of the dishwasher tub so that the first tabs can be registered with the first pair of apertures, and the second tabs can be registered wit the second pair of apertures.

The first pair of tabs are each in the shape of J-shaped hooks which are adapted to fit within the first apertures of the base support member. These J-shaped hooks are inserted into the first apertures, and provide a hinged connection between the tub and the base support so that the tub can be pivoted about a horizontal axis coinciding with the hinged connections between the J-shaped hooks and the apertures in the base support member. The tub is then pivoted about this horizontal axis until the second tabs protrude within the second apertures of the base support member. The second tabs include spring clips which are adapted to spring inwardly so as to pass through the second apertures during downward movement of the tub, and so as to spring outwardly after passing through the second apertures, thereby engaging the bottom surface of the base support member. When the tub has been completely assembled, the J-shaped members engage the bottom surface of the base support, and the spring arms of the second tabs also engage the bottom of the base support to prevent upward movement of the tub relative to the base support. Similarly, the first and second tabs are shaped so as to engage the margins of the first and second apertures respectively to prevent horizontal movement of the tub relative to the base support after assembly.

While the J-shaped members permit the tub to pivot about a horizontal axis relative to the base support during assembly, the shape of both the first and second tabs prevents horizontal movement relative to the base support and the tub during assembly. This means that the tub can be assembled to the base support with a single pivoting action without requiring two separate motions during assembly. This facilitates the simple, quick and easy assembly of the two members during manufacture.

BRIEF DESCRIPTION OF THE FIGURES OF THE DRAWINGS

FIG. 1 is a perspective view of an assembled dishwasher tub and base support.

FIG. 2 is an enlarged detailed perspective view of the interlocking tabs of the tub and the apertures of the base support member.

FIG. 3 is a perspective view showing the bottom of the tub prior to assembly to the base support.

FIGS. 3A and 3B are enlarged perspective detailed views taken along lines 3A—3A and 3B—3B respectively of FIG. 3.

DETAILED DESCRIPTION OF THE PREFERRED EMBODIMENT

Figure 4:
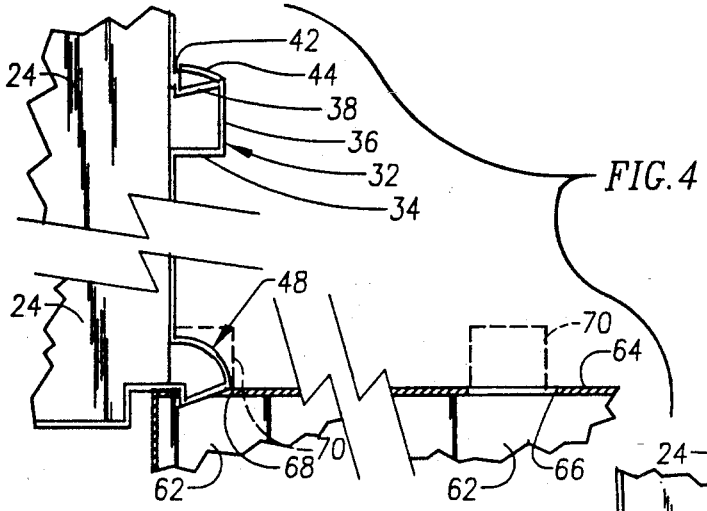
FIG. 4 is a side sectional view showing the position of the two tabs prior to assembly.

Referring to the drawings, numeral 10 generally refers to a partially assembled dishwasher assembly of the present invention which comprises a tub 12 and a base 14. Tub 12 includes a top tub wall 16, side tub walls 18, 20, and a bottom wall 22. Extending downwardly as extensions of the opposed side tub walls 18 and 20 are a pair of pedestal members or legs 24, 26 which include horizontal pedestal flanges 28, 30 extending along the bottoms thereof respectively. Extending downwardly from the horizontal pedestal flanges 28, 30 are a pair of front tabs 32. Front tabs 32 each include a vertical back wall 34, a horizontal bottom wall 36, an angled wall 38, and a horizontal top wall 40. As best shown in FIG. 3A, the forward edge of horizontal top wall 40 includes a forwardly presented shoulder 42. Connected to the lower edge of angled wall 38 is a spring member 44 which includes an upper end edge 46. The front tab 32 is made of a plastic material, and spring member 44 is flexible so that its upper end edge 46 can spring toward and away from the angled wall 38.

Also extending downwardly from the bottom surfaces of horizontal pedestal flanges 28, 30 are a pair of rear tabs 48 each of which is in the form of a J-shaped hook having an arcuate front wall 50, an inclined wall 52, a notch bottom wall 54, a notch middle wall 56, and a notch top wall 58. Walls 54, 56, 58 form a notch 60.

Base 14 comprises a pair of spaced apart base side legs 62 which are interconnected by a horizontal base support member 64. Within base support member 64 are a pair of front apertures 66 which are adapted to receive front tabs 32, and a pair of rear apertures 68 which are adapted to receive rear tab members 48. Extending upwardly from the outside edges of apertures 66, 68 are upstanding tabs or flaps 70.

Figure 5:
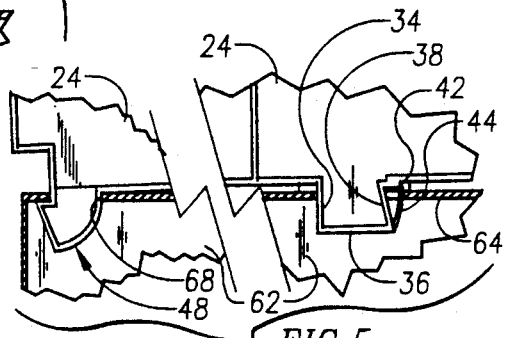
FIG. 5 is a view similar to FIG. 4 showing the positions of the tabs in an intermediate position during assembly.
Figure 6:
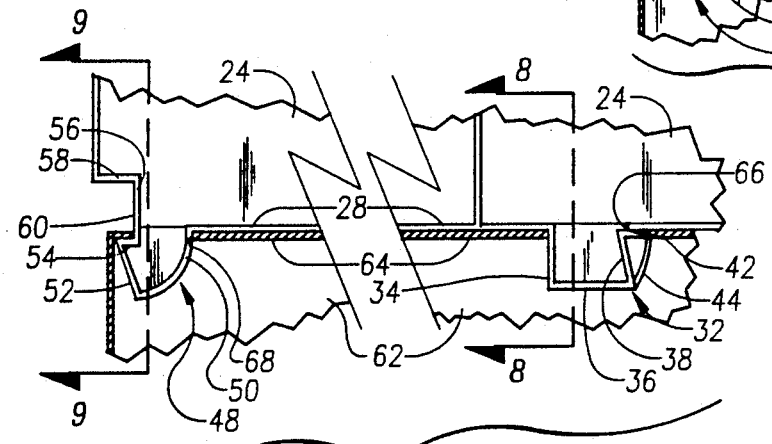
FIG. 6 is a view similar to FIGS. 4 and 5 showing the positions of the tabs after assembly.
Figure 7:
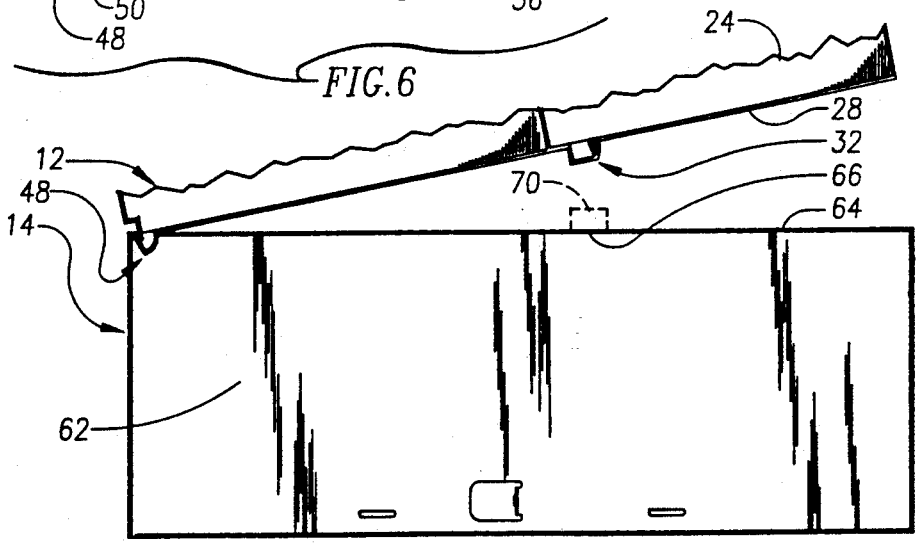
FIG. 7 is a reduced scale sectional view taken along line 7—7 of FIG. 1 illustrating the position of the tub prior to assembly.
Figure 8:
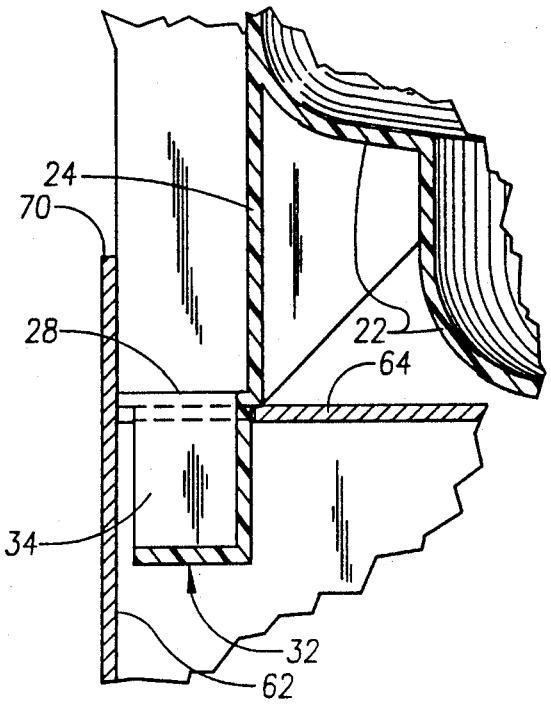
FIG. 8 is a sectional view taken along line 8—8 of FIG. 6.
Figure 9:
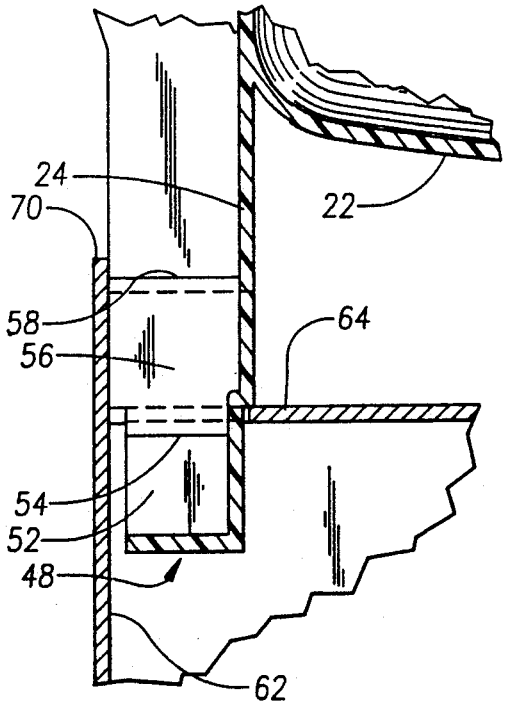
FIG. 9 is a sectional view taken along line 9—9 of FIG. 6.

The method of assembly of the tub 12 to the base 14 is illustrated in FIGS. 3–7. The first step in the assembly is to insert the J-shaped rear tabs 48 into the rear apertures 68 of base 14. In this position as can be seen in FIGS. 4–6, the notch bottom wall 54 hooks over the rear margin of rear aperture 68 and forms a hinged connection therewith. The arcuate front wall 50 has a radius of curvature which is concentric to the pivotal axis formed by the hinged connection of notch bottom wall 54 with the aperture 68. The size of the rear tab 48 is such that the arcuate front wall 50 fits within the aperture during pivotal movement of the tub 12 so as to prevent horizontal movement of the tub 12 relative to the base support member 64 during pivotal movement from the inclined position shown in FIGS. 3 and 4 to the assembled position shown in FIG. 6. As can be seen in FIG. 6, the notch bottom wall 54 of rear tab 48 engages the undersurface of the base support member 64 after assembly is complete so as to prevent vertical movement of the rear edge of the tub 12 relative to the base 14. In this position, the arcuate front wall 50 engages the front margin of the rear aperture 68 so as to prevent horizontal movement of the tub 12 in a forward direction, and the notch middle wall 56 engages the rear margin of aperture 68 so as to prevent rearward relative movement of the tub 12 with respect to the base 14. Similarly, as can be seen in FIGS. 8 and 9, both the rear tabs 48 and the front tabs 32 effectively engage the side margins of apertures 68, 66 to prevent lateral horizontal movement of the tub 12 relative to the base 14. Although there is a gap between front and rear tabs 32 and 48 and side leg 62 of base 14 as shown in FIGS. 8 and 9, the pedestal members 24 and 26 bear against the upstanding tabs or flaps 70 to prevent lateral movement of the tub 12 on the base 14.

FIGS. 5 and 6 show the spring action of the spring member 44 during assembly of the tub 12 to the base 14. As the tub 12 pivots about the hinged connection provided by the J-shaped rear tabs 48, the front tabs 32 register with and pass through the front apertures 66 of base support member 64. The spring member 44 springs inwardly during the time that the front tab 32 is passing through aperture 66 as is illustrated in FIG. 5. However, after the tub 12 has reached its fully assembled position as shown in FIG. 6, the spring member 44 is free to spring outwardly away from angled wall 38 so that the end edge 46 of spring member 44 engages the bottom surface of base support member 64. This holds the front tab 32 against upward pivotal movement out of apertures 66 after assembly.

Another important feature of the front tabs 32 is the fact that the forwardly presented shoulder 42 engages the front margin of front apertures 66 so as to prevent forward horizontal movement of the tub relative to the base 14. The notch middle wall 56 of rear tabs 48 engages the rear margin of aperture 68 so as to prevent rearward movement of the tub 12 relative to the base 14. As can be seen in FIGS. 8 and 9, the side edges of the tabs 32, 48 as well as tabs or flaps 70 prevent lateral horizontal movement of the tub 12 relative to the base 14.

In the preferred embodiment, the tub 12 is molded from a plastic material which is preferrably polypropylene. The base 14 is preferrably constructed of metal. However, the materials of the base 14 and the tub 12 can be varied without detracting from the invention. It should be noted that no screws, rivets, or other fasteners are used. The tub 12 ca be quickly and easily assembled to the base 14 by single pivotal movement, and there is no horizontal movement of the tub 12 relative to the base 14 after the pivoting movement has begun. Once assembled, the tabs 32, 48 hold the tub 12 against horizontal movement relative to the base 14 in any direction, and also hold the tub 12 against upward vertical movement relative to the base 14.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

I claim:

1. A dishwasher tub and support assembly comprising:

a base having a horizontal base support member, said base support member having an upwardly presented surface and a downwardly presented surface, first and second spaced apart apertures being formed in said base support member;

said base support member forming perimetric edges extending around said first and second apertures;

a tub including a top tub wall, a bottom tub wall, a back tub wall, and opposite side tub walls forming a washing compartment therein, said bottom tub wall having a downwardly presented surface;

first and second tab means both connected to said tub and both extending downwardly within and through said first and second apertures respectively to a position below said downwardly presented surface of said bottom tub wall;

said first and second tab means engaging at least portions of said perimetric edges of said first and second apertures and holding said tub against horizontal movement with respect to said base;

both of said first and second tab means engaging said downwardly presented surface of said horizontal base support member and holding said tab against vertical movement upwardly away from said base.

2. A dishwasher tub and support assembly according to claim 1 wherein pedestal means are connected to said tub and extend downwardly therefrom for engagement with said upwardly presented surface of said base support member, said first and second tab means being connected to said pedestal means.

3. A dishwasher tub and support assembly according to claim 2 wherein said pedestal means are integrally formed as extensions of said opposite side tub walls.

4. A dishwasher tub and support assembly according to claim 3 wherein said first and second tab means are integrally formed with said pedestal means.

5. A dishwasher tub and support assembly according to claim 1 wherein said first tab means comprises a hook member engaging a first portion of said perimetric edge of said first aperture and engaging said downwardly presented surface of said horizontal base support member.

6. A dishwasher tub and support assembly according to claim 5 wherein said second tab means comprises a first tab member including a shoulder engaging said perimetric edge of said second aperture and a second tab member engaging said downwardly presented surface of said base support member.

7. A dishwasher tub and support assembly according to claim 6 wherein said second tab member of said second tab means comprises a spring finger having a lower end connected to said first tab member and having an upper end above said lower end and engaging said downwardly presented surface of said base support member.

8. A dishwasher according to claim 7 wherein said spring finger is flexible and said upper end of said spring finger is yieldably movable from a normal position engaging said downwardly presented surface of said base support member to a second position wherein said spring finger will be free to pass through said second aperture in said base support member.

9. A dishwasher tub and support assembly comprising:

a base having a horizontal base support member, said base support member having an upwardly presented surface and a downwardly presented surface, first and second apertures being formed in said base support member, said base support member forming a plurality of perimetric edges extending around said first and second apertures;

a tub including a top tub wall, a bottom tub wall, a back tub wall, and opposite side tub walls forming a washing compartment therein, said bottom tub wall having a downwardly presented surface;

first tab means connected to said tub and extending downwardly below said downwardly presented surface of said bottom tub wall and being registered with and protruding through said first aperture to provide a hinged connection between said tub and said base for hinged movement of said tub from an elevated position wherein said downwardly presented surface of said bottom tub wall is inclined at an angle with respect to said upwardly presented surface of said base support member to a lowered position wherein said downwardly presented surface of said bottom wall is parallel to said upwardly presented surface of said base support member;

said first tab means including wall means engaging one of said perimetric edges extending around said first aperture and forming said hinged connection during hinged movement of said tab from said elevated position to said lowered position, said wall means engaging said downwardly presented surface of said base support member when said tab is in said lowered position to prevent upward movement of said tab from said lowered position;

second tab means connected to said tub and extending downwardly below said downwardly presented surface of said bottom tub wall, said second tab means being positioned and shaped to register with and protrude within said second aperture when said tub is in said lowered position.

10. A dishwasher tub and support according to claim 9 wherein said second tab means comprises a locking member capable of passing through said second aperture during movement of said tub from said elevated to said lowered position, said locking member engaging said downwardly presented surface of said base support member when said tub is in said lowered position to prevent upward movement of said tub from said lowered position.

11. A dishwasher tub and support according to claim 9 wherein said first and second tab means engage said perimetric edges of said first and second apertures respectively for preventing relative horizontal movement between said tub and said base when said tub is in said lowered position.

12. A method for assembling a tub and base, said base comprising a horizontal base support member having upwardly and downwardly presented surfaces, first and second apertures extending through said base support member, and a plurality of perimetric edges extending around each of said first and second apertures, said tub comprising a bottom tub wall having a downwardly presented surface, and first and second tab means connected to said tub and extending downwardly below said bottom tub wall, said method comprising:

inserting said first tab means from above said first aperture through said first aperture of said base support means so that said tab means protrudes below said tub wall with said tub being in an elevated position wherein said second tab means is elevated above said second aperture;

pivoting said tub about a horizontal hinge axis formed by hinged movement between said first tab means and one of said perimetric edges of said first aperture to a lowered position wherein said second tab means protrudes within said second aperture and retentively engages said base support member to prevent both horizontal and vertical movement of said tub with respect to said base;

engaging said downwardly presented surface of said base support member with a portion of said first tab means after said tub has been pivoted to said lowered position so as to hold said tub against vertical movement of said tub with respect to said base support member;

13. A method according to claim 12 and further comprising engaging said downwardly presented surface of said base support member with a portion of said second tab means after said tub has been pivoted to said lowered position so as to hold said tub against vertical movement with respect to said base support member.

14. A method according to claim 12 and further comprising engaging at least some of said perimetric edges of said first aperture with a second portion of said first tab means when said tub has been pivoted to said lowered position so as to hold said tub against horizontal movement with respect to said base support member.

15. A method according to claim 12 and further comprising engaging at least some of said perimetric edges of said second aperture with a second portion of said second tab means when said tub has been pivoted to said lowered position so as to hold said tub against horizontal movement with respect to said base support member.

* * * * *